United States Patent [19]

Hoshino

[11] Patent Number: 4,747,333

[45] Date of Patent: May 31, 1988

[54] REMOTELY CONTROLLED FOOT PEDAL OPERATED BEATERS FOR DRUMS

[75] Inventor: Yoshihiro Hoshino, Nagoya, Japan

[73] Assignee: Hoshino Gakki Co., Ltd., Japan

[21] Appl. No.: 925,814

[22] Filed: Oct. 30, 1986

[30] Foreign Application Priority Data

Jun. 18, 1986 [JP] Japan ..... 61-093003[U]

[51] Int. Cl.[4] ..... G10D 13/02

[52] U.S. Cl. ..... 84/422 R

[58] Field of Search ..... 84/422 R, 422 C

[56] References Cited

U.S. PATENT DOCUMENTS

| | | | |
|---|---|---|---|
| 609,570 | 8/1898 | Bowden | 84/422 X |
| 2,581,515 | 1/1952 | Christian | 84/422 R |
| 3,967,523 | 7/1976 | Currier et al. | 84/422 R |
| 4,346,638 | 8/1982 | Hoshino | 84/422 R |
| 4,538,499 | 9/1985 | Livingston | 84/422 R |

FOREIGN PATENT DOCUMENTS

| | | | |
|---|---|---|---|
| 649914 | 2/1951 | United Kingdom | 84/422 R |

*Primary Examiner*—Lawrence R. Franklin

*Attorney, Agent, or Firm*—Ostrolenk, Faber, Gerb & Soffen

[57] ABSTRACT

A flexible cable provides for remote control of foot pedal operated drum beater for bass drums. The cable extends between the foot pedal and the beater, which can be separated.

5 Claims, 3 Drawing Sheets

REMOTELY CONTROLLED FOOT PEDAL OPERATED BEATERS FOR DRUMS

BACKGROUND OF THE INVENTION

1. Field of the Invention

This invention relates to foot pedal operated beaters for drums and more particularly to a remotely controlled beater for a bass drum.

2. Description of the Prior Art

In conventional foot pedal operated beaters for drums, the beater and the foot pedal are combined in a single unit. This requires that the drum beater be located in front of the performer, so that he or she can operate the foot pedal. As the beater is next to the drum, this results in the performer being hidden behind the drum.

OBJECTS OF THE INVENTION

It is an object of the invention to provide a drum beater which enables the drum being beaten to be located away from the performer.

It is a further object of the invention to provide a remotely controlled drum beater pedal.

SUMMARY OF THE INVENTION

These, as well as other objects, are achieved by the invention. One embodiment of the invention includes a foot pedal, a remote beater rotatably adapted to swing in an arc, a flexible sheathed cable, a first linkage connecting the foot pedal to one end of the sheathed cable and a second linkage connected to the other end of the cable and to the drum beater. The cable transmits motion of the foot pedal to the drum beater, and the sheath around the cable aids the cable to transmit the motion. With this arrangement, the drum can be located at any convenient position and obstruction of a view of the performer can be avoided.

BRIEF DESCRIPTION OF THE DRAWINGS

A more complete understanding of the present invention, as well as other objects and advantages thereof not enumerated, will become apparent upon consideration of the following description, considered in light of the accompanying drawings, wherein.

DETAILED DESCRIPTION OF THE PREFERRED EMBODIMENT

Figure 1:
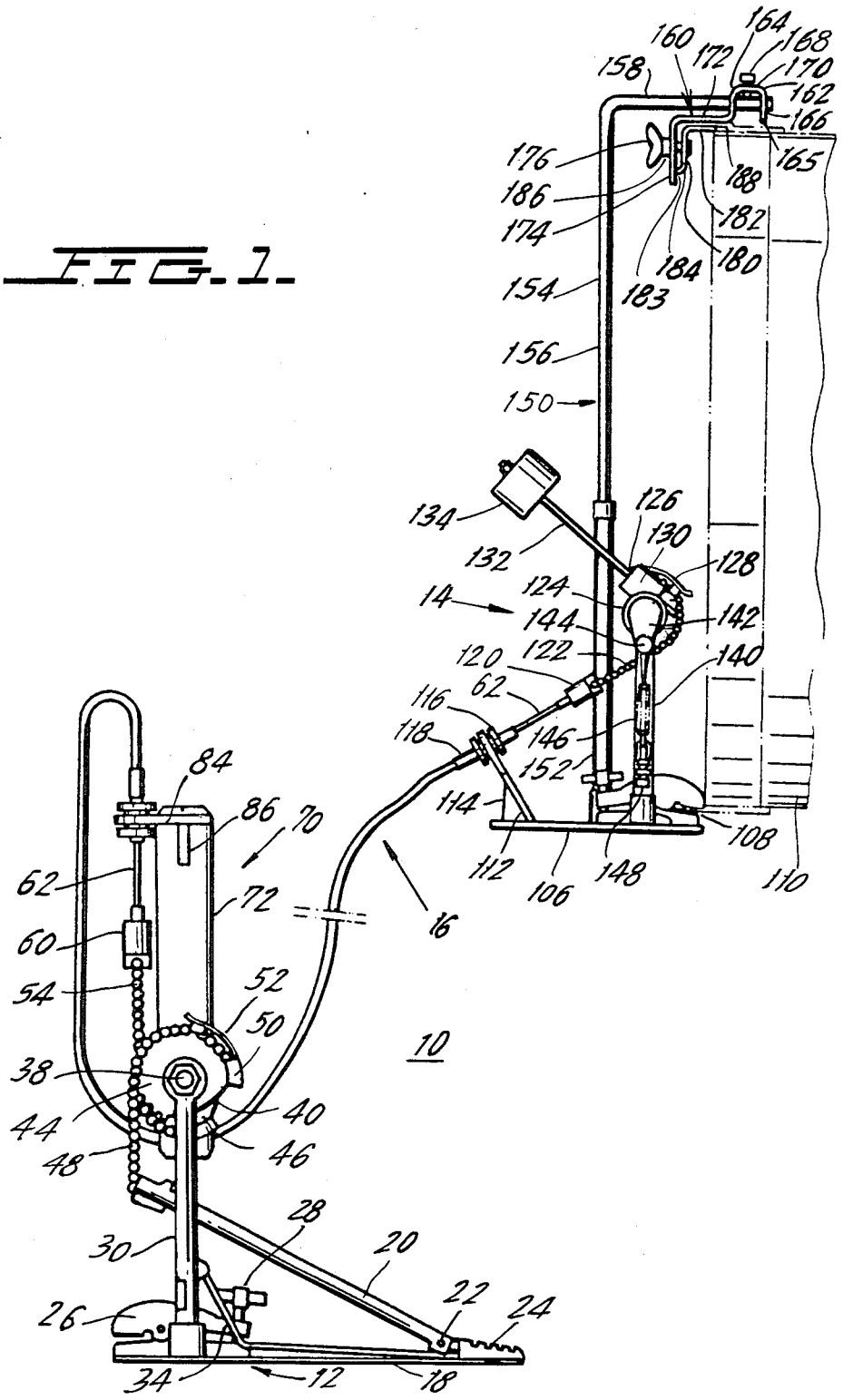
FIG. 1 is a side view of the entire drum beater according to the invention.

Referring to FIG. 1, the drum beater pedal 10 according to the invention has as its major components the pedal assembly 12, the drum beater 14, and an interconnecting sheathed cable 16.

The pedal assembly 12 has a base 18 and a pedal 20 which are pivotally connected at hinge 22. A serrated heel plate 24 is located on the base 18 adjacent the hinge 22. A clamp 26 with an adjusting crank 28 attaches the pedal to a stationary anchoring device for stability.

Figure 2:
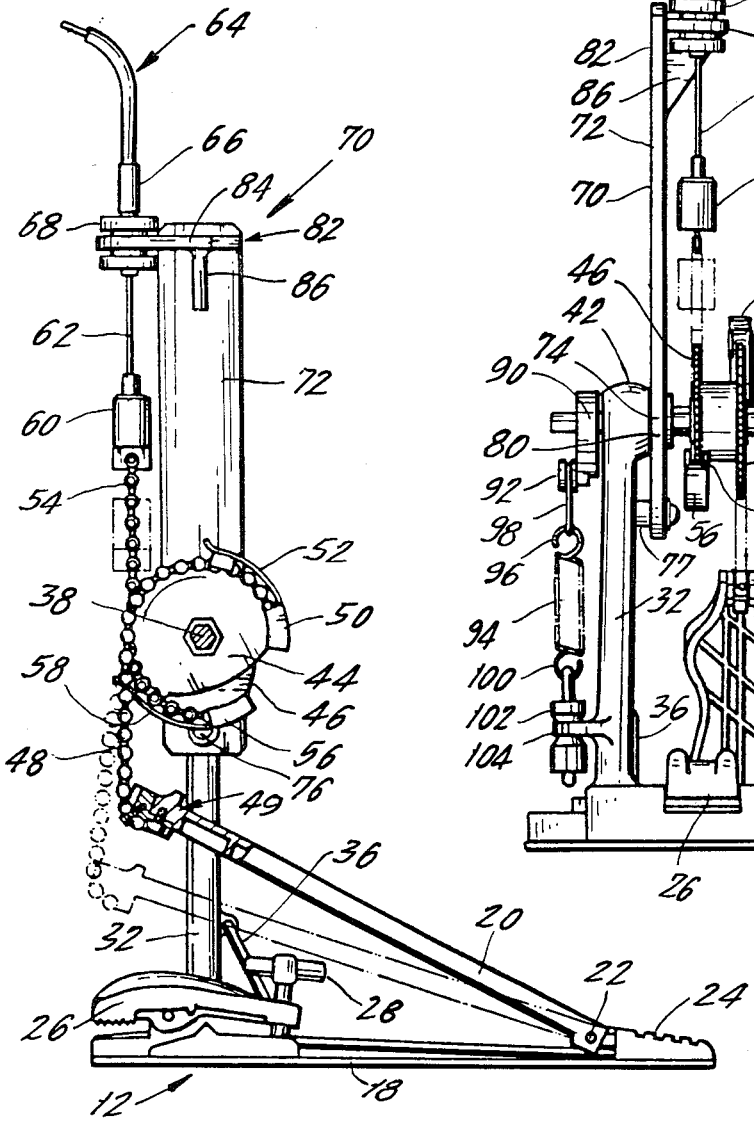
FIG. 2 is a partially cross-sectioned side elevation view of the pedal assembly.
Figure 3:
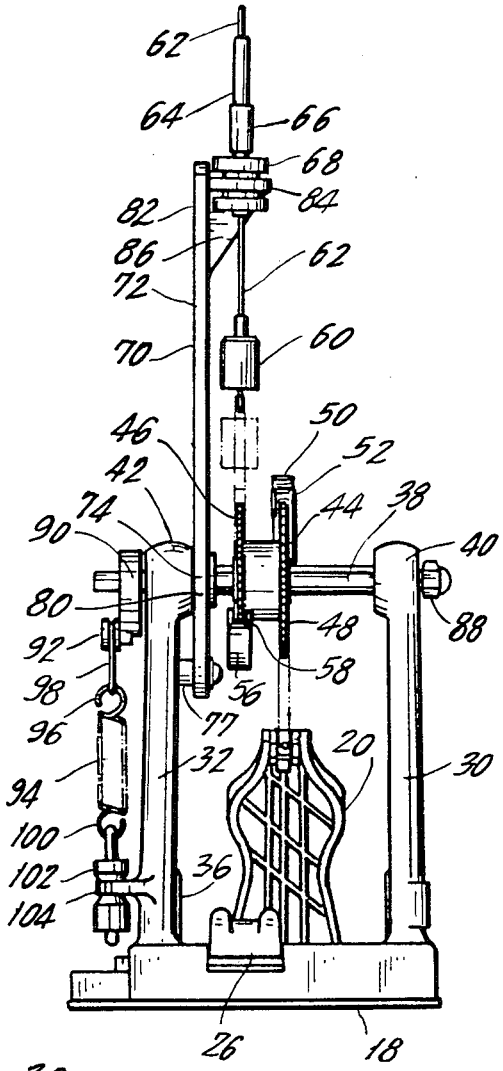
FIG. 3 is a rear elevation view of the pedal assembly.

The pedal assembly 12 also has a first upright member 30 (FIGS. 1 and 3) and a second upright member 32 (FIGS. 2 and 3). The first upright member is stabilized by a first brace 34 connected between the first upright member 30 and the base 18. The second upright member 32 is stabilized by a second brace 36 connected between the second upright member 32 and the base 18. The first and second upright members 30 and 32 support a rotatable shaft 38 which rotates within a first journal 40 atop the first upright member 30 and a second journal 42 atop the second upright member 32. The rotatable shaft 38 carries a first sprocket 44 toward the right in FIG. 3 and a second sprocket 46 toward the left in FIG. 3.

A first link chain 48 has one end connected to the pedal 20 of the pedal assembly 12 and the other end wrapped around the teeth of the first sprocket 44. The first chain 48 is secured to the first sprocket 44 by a first securing device 50 to which is attached the protective chain cover 52. When the pedal 20 is depressed, the chain 48 is pulled in a downward direction causing the first sprocket 44, and in turn the shaft 38, to rotate counterclockwise in FIGS. 1 and 2. The second sprocket 46 has wrapped around its teeth a second link chain 54 which is secured to the second sprocket 46 by a second securing device 56 to which is attached the protective chain cover 58. The other end of the second chain 54 is attached to a connecting link 60. The connecting link 60 is, in turn, connected to a cable 62.

The cable 62 is part of the interconnecting sheathed cable 16. The cable 62 is like a Bowden cable, in that it is flexible but nonstretchable, so that it transmits lengthwise pulling or pushing forces and motion. Portions of the cable 62 are enclosed in a cable sheath 64. The sheath is held stationary, as described below, as the cable within is moved. The sheath enables the cable to flex and also enables the cable to move lengthwise to transmit motion from the pedal to the drum beater. On the end of the cable 62 nearest the pedal assembly 12, the cable sheath 64 terminates in a sheath collar 66. The cable 62 itself passes through a cable collar 68 supported by a bracket assembly 70. The bracket assembly is comprised of a vertical member 72 affixed to the second upright member 32 at its lower portion 74 by a bolt 76 and by an extension member 77 of the journal 42 which passes through an opening 80 in the lower portion 74 of the vertical member 72. At the upper portion 82 of the vertical member 72 there is a horizontal member 84 welded to the vertical member 72 and extending outwardly therefrom. For reinforcement, the horizontal member 84 is supported by a gusset 86.

The shaft 38 runs between and through the journals 40 and 42, extending outwardly from them. On the end of the shaft external to the journal 40, there is a nut 88. On the opposite end of the shaft 38, there is a bushing 90 which has an offset portion 92. The purpose of the offset portion 92 is to provide a connection for a spring assembly 94. The spring assembly 94 has one end connected by a first hook 96 to a link 98 which fastens on to the offset portion 92. The spring assembly 94 has a second hook 100 which connects to a link and collar assembly 102 which in turn is secured to a bracket 104 attached to the second upright member 32.

Figure 5:
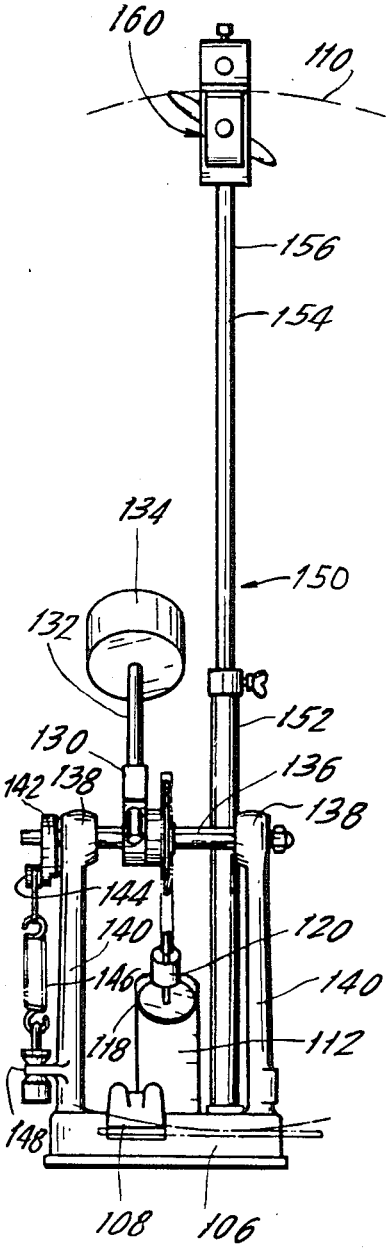
FIG. 5 is a rear elevation view of the drum beater.
Figure 4:
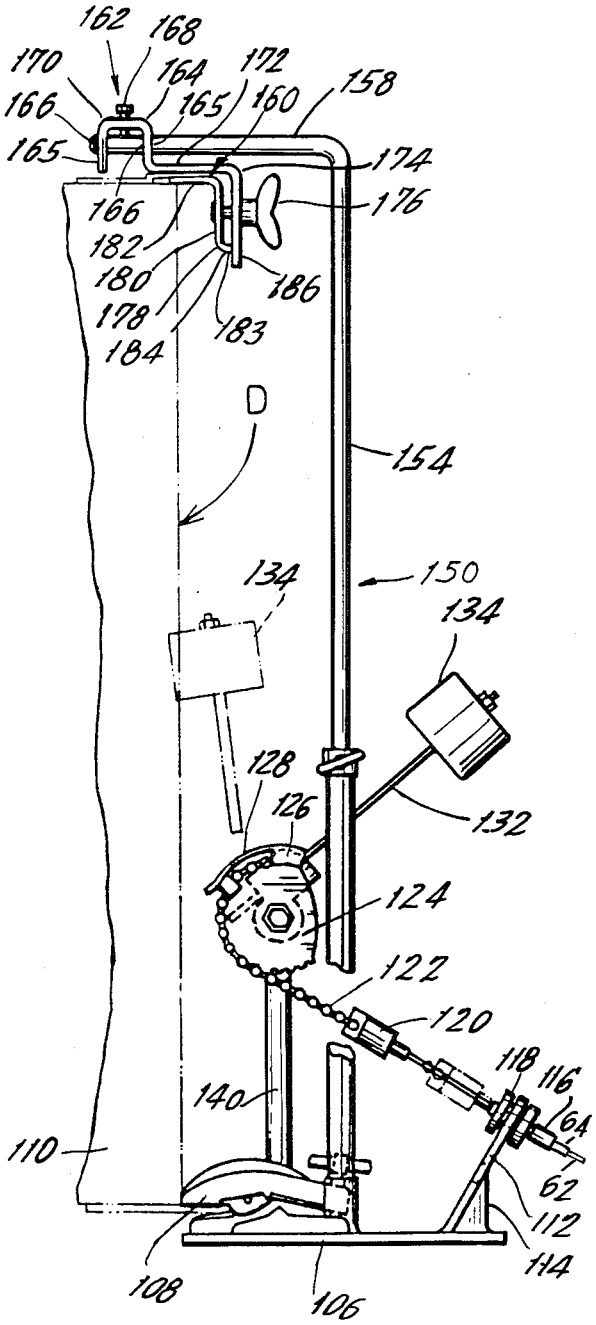
FIG. 4 is a partially cross-sectioned elevation view of the drum beater.

The beater assembly 14 is now explained with reference to FIGS. 4 and 5. The beater assembly has a base 106 with a clamp 108 which is attached to the drum 110, shown here in partial phantom view. The base 106 has a bracket 112, supported by a gusset 114, which carries a cable collar 116. The other end of cable 62 passes through the cable collar 116. Adjacent the cable collar 116 is a sheath collar 118 at the opposite end of the cable sheath 64 from the first sheath collar 66. The end of the cable 62 passing through the cable collar 116 is attached to a connecting link 120. In turn, the connecting link 120 is attached to a link chain 122. The chain 122 is wrapped around the teeth of a sprocket 124 and is secured to the sprocket 124 by a securing device 126 to which is attached a protective chain cover 128. A mounting bracket 130 on the sprocket 124 is connected to one end of the shaft 132. At the other end of the shaft 132 is a beater block 134 which strikes the head of the drum 110.

The sprocket 124 is rigidly affixed to a shaft supported by journals 138 which are in turn positioned atop upright members 140. In the same manner as the pedal assembly 12, there is a bushing 142 on one end of the shaft 136, having an offset portion 144. A spring assembly 146 is connected between the offset portion 144 and a bracket on the upright member 140 in the same fashion as the spring assembly 94 on the pedal assembly 12.

For added stability, an upper securing assembly 150 is provided for the beater assembly 14. The upper securing assembly 150 comprises a first telescoping section 152 which is connected to a second telescoping section 154 which has a vertical portion 156 connected to a horizontal portion 158. A bracket assembly 160 is attached to the end of the second telescoping section 154 on the horizontal portion 158.

The bracket assembly has a first bracket member 162 which has a U-shaped portion 164 having legs 165 through which the horizontal portion 158 of the second telescoping section 154 passes. Openings 166 are provided in the U-shaped portion 164 for this purpose. A tightening bolt 168 passing through the base 170 of the legs 165 of the U-shaped portion 164 serves to secure the bracket in place on the horizontal portion 158. Extending at 90° from one leg 165 of the U-shaped portion 164 of the first bracket member 162 is a horizontal section 172 which terminates in a vertical section 174 extending downwardly from the horizontal section 172. The vertical section 174 is parallel to the vertical portion 156 of the second telescoping section 154. By means of a wing nut and bolt assembly 176, a second bracket member 178 is loosely affixed to the first bracket member 162. The second bracket member 178 has an L-shape and likewise has a vertical section 180 and a horizontal section 182. The free end 183 of the vertical section 180 has an offset portion 184 which rests in an opening 186 in the vertical section 174 of the first bracket member 162. When the wing nut and bolt assembly 176 is tightened, the horizontal section 182 of the second bracket member 178 is drawn towards the horizontal section 172 of the first bracket member 162. This causes the rim 188 of the drum 110 to be firmly clamped in-between.

The operation of the remotely controlled drum beater assembly is now described. The performer depresses the pedal 20 which pulls the chain 48 and rotates the first sprocket 44 in a counterclockwise direction. This in turn rotates the shaft 38 in the same direction causing the second sprocket 46 to rotate counterclockwise. When the second sprocket 46 rotates, the second chain 54 is drawn downwardly pulling on the connecting link 60 which draws down cable 62. Since the cable sheath 64 terminates at both ends with first and second sheath collars 66 and 118, and the cable 62 passes through cable collars 68 and 116, the motion of the cable is transmitted to the connecting link 120 of the beater assembly 14. This in turn causes the chain 122 to move forcing the sprocket 124 to rotate clockwise and move the shaft 132 and the beater block 134 toward the drum 110. With this arrangement, the drum can be located at a remote position from the pedal assembly 12, affording an unobstructed view of the performer, for example.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A remotely controlled drum beater assembly, comprising:

drum beater means movable for striking a drum; the drum beater means including a rod, a beater affixed to the rod and a rotatable shaft to which the rod is affixed for rotating the beater about the axis of the shaft toward and away from the surface of the drum; first spring return means for urging the beater away from the drum;

pedal means movable by a performer toward a beating position; the pedal means being separated from the drum beater means;

a transmission cable connected with the pedal means for being moved lengthwise as the pedal means is moved by a performer and the cable being connected with the beater means such that movement of the pedal means toward the beating position causes lengthwise movement of the cable which moves the beater means to strike the drum;

the drum beater means further including a sprocket on the shaft and connected to the cable such that movement of the cable in turn rotates the sprocket and thereby the shaft and moves the beater toward the drum;

the pedal means being so connected with the cable as to move the beater to strike the drum when the pedal is moved toward the beating position; second spring return means for returning the pedal away from the beating position and for returning the cable;

the pedal means including a rotatable shaft having a first sprocket and a second sprocket fixed thereto, a first chain connected between the pedal and the first spocket and a second chain connected between the second sprocket and the cable, such that the chains move with rotation of the sprockets.

2. A remotely controlled drum beater assembly as set forth in claim 1, further comprising means for holding the sheath stationary while the cable within is moved for enabling the cable to transmit motion.

3. A remotely controlled drum beater assembly as set forth in claim 1, wherein the cable is generally nonextensible.

4. A remotely controlled drum beater assembly as set forth in claim 1, wherein the cable is generally flexible.

5. A remotely controlled drum beater assembly as set forth in claim 4, wherein the transmission cable further includes a sheath surrounding the cable.

* * * * *